US005943427A

United States Patent [19]

Massie et al.

[11] Patent Number: 5,943,427

[45] Date of Patent: Aug. 24, 1999

[54] METHOD AND APPARATUS FOR THREE DIMENSIONAL AUDIO SPATIALIZATION

[75] Inventors: Dana C. Massie, Aptos; John D. Sun, San Jose; Sol D. Friedman, Scotts Valley; William L. Martens, Cupertino; David P. Rossum, Aptos, all of Calif.

[73] Assignee: Creative Technology Ltd., Singapore, Singapore

[21] Appl. No.: 08/425,119

[22] Filed: Apr. 21, 1995

[51] Int. Cl.[6] ..... H04R 5/00

[52] U.S. Cl. ..... 381/17; 381/1; 381/63

[58] Field of Search ..... 381/1, 17, 18, 381/26, 61, 63, 25, 310, 98, 100

[56] References Cited

U.S. PATENT DOCUMENTS

| | | | |
|---|---|---|---|
| 3,665,105 | 5/1972 | Chowning | 381/17 |
| 4,648,115 | 3/1987 | Sakashita | 381/17 |
| 4,731,848 | 3/1988 | Kendall et al. | 381/63 |
| 4,792,974 | 12/1988 | Chace | 381/1 |
| 4,817,149 | 3/1989 | Myers | 381/1 |
| 4,908,858 | 3/1990 | Ohno | 381/1 |
| 5,046,097 | 9/1991 | Lowe et al. | 381/17 |
| 5,073,942 | 12/1991 | Yoshida et al. | 381/63 |
| 5,337,363 | 8/1994 | Platt | 381/17 |
| 5,371,799 | 12/1994 | Lowe et al. | 381/17 |
| 5,500,900 | 3/1996 | Chen et al. | 381/17 |
| 5,521,981 | 5/1996 | Gehring | 381/17 |

FOREIGN PATENT DOCUMENTS

| | | | |
|---|---|---|---|
| 53-137101 | 11/1978 | Japan | 381/1 |
| 53-684400 | 4/1983 | Japan | 381/1 |
| 62-140600 | 6/1987 | Japan | 381/1 |

OTHER PUBLICATIONS

Loomis et al., Active Localization of Virtual Sounds, J. Acoust. Soc. Am., vol. 88, No. 4, Oct. 1990, pp. 1757–1764.

Wallach et al., The Precedence Effect in Sound Localization, J. Audio Eng. Soc., vol. 21, No. 10, Dec. 1973, pp. 817–826.

Rodgers, Pinna Transformations and Sound Reproduction, J. Audio Eng. Soc., vol. 29, No. 4, Apr. 1981, pp. 226–234.

Madsen, Extraction of Ambiance Information from Ordinary Recordings, J. Audio Eng. Soc., vol. 18, NO. 5, Oct. 1970, pp. 490–496.

Wiener, On the Diffraction of a Progressive Sound Wave by the Human Head, J. Acoust. Soc. Am., vol. 19, No. 1, Jan. 1947, pp. 143–146.

Hebrank et al., Are Two Ears Necessary for Localization of Sound Sources on the Median Plane?, J. Acoust. Soc. Am., vol. 56, No. 3, Sep. 1974, pp. 935–938.

Shaw, Earcanal Pressure Generated by a Free Sound Field, J. Acoust. Soc. Am., vol. 39, No. 3, 1966, pp. 465–470.

Megrgardt, Transformation Characteristics of the External Human Ear, J. Acoust. Soc. Am. vol. 61, No. 6, Jun. 1977, pp. 1567–1576.

Roffler et al., Localization of Tonal Stimuli in the Vertical Plane, J. Acoust. Soc. Am., vol. 43, No. 6, 1968, pp. 1260–1266.

(List continued on next page.)

*Primary Examiner*—Curtis A. Kuntz
*Assistant Examiner*—Duc Nguyen
*Attorney, Agent, or Firm*—Townsend and Townsend and Crew LLP

[57] ABSTRACT

A digital audio spatialization system that incorporates accurate synthesis of three-dimensional audio spatialization cues responsive to a desired simulated location and/or velocity of one or more emitters relative to a sound receiver. Cue synthesis may also simulate the location of one or more reflective surfaces in the receiver's simulated acoustic environment. The cue synthesis techniques are suitable for economical implementation in a personal computer add-on card.

29 Claims, 15 Drawing Sheets

Microfiche Appendix Included
(1 Microfiche, 61 Pages)

OTHER PUBLICATIONS

Gardner, et al., Problems of Localization in the Median Plane: Effect of Pinnae Cavity Occlusion, J. Acoust. Soc. Am., vol. 53, No. 2, 1973, pp. 400–408.

Handbook for Sound Engineers: The New Audio Cyclopedia, Acoustics–Psychoacoustics, 1987 by Howard W. Sams & Co., pp. 25–35.

McGreevy, Virtual Reality and Planetary Exploration, 29th AAS Goddard Memorial Symposium, Mar. 1991, pp. 1–13.

Wenzel et al., A Virtual Display System for Conveying Three–Dimensional Acoustic Information, Proceedings of the Human Factors Society—32nd Annual Meeting, 1988, pp. 86–90.

Wightman et al., Headphone Simulation of Free–Field Listening. I: Stimulus Synthesis, J. Acoust. Soc. Am., vol. 85, No. 2, Feb. 1989, pp. 858–867.

Linkwitz, Improved Headphone Listening: Build a Stereo–Crossfeed Circuit, Audio, Dec. 1971, pp. 42–43.

Eargle, An 'Earing' Earing, Audio, Sep. 1990, pp. 25–32.

Pohlmann, Psycho–What? Psychoacoustics, Stereo Review, Sep. 1989, pp. 117–120.

Klein, Audio Update—Can You Believe Your Ears?, Radio–Electronics, Dec.1987, pp. 40–45.

Feldman, Beyond Stereo: The Sound Retrieval System Adds a New Dimension to Audio Reproduction, Radio–Electronics, Sep. 1989, pp. 51–54.

Vaughan, How We Hear Direction, Audio, Dec. 1983, pp. 51–55.

Roeffler et al., Factors that Influence the Localization of Sound in the Vertical Plane, J. Acoust. Soc. Am., vol. 43, No. 6, 1968, pp. 1255–1259.

Chamberlin, Musical applications of microprocessors, Hayden Book CO., pp. 446–459, 1980–91.-

PERSONAL COMPUTER ARCHITECTURE

SUBSITUTION ADDER

METHOD AND APPARATUS FOR THREE DIMENSIONAL AUDIO SPATIALIZATION

SOURCE CODE APPENDICES

Microfiche appendices of assembly language source code for a preferred embodiment (©1995 E-mu Systems Inc.) are filed herewith. A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. The total number of Microfiche is 1 and the total number of pages is 61.

BACKGROUND OF THE INVENTION

This invention pertains to digital sound generation systems and particularly to systems which simulate the three dimensional position of one or more sound emitters and/or reflective surfaces relative to a sound receiver.

Extensive research has been done to model the way human listeners determine the location and velocity of one or more sound emitters. In short, it has been determined that the brain relies on numerous so-called "cues" or properties of the received sound that indicate the location and/or velocity of an emitter. Perhaps the simplest cue is the loudness of the sound; a loud sound will seem closer than a faint sound.

Another cue is the arrival time of a sound at each ear. For sounds originating from locations off to the left or right side of the listener's head there is a relatively large difference between arrival times at each ear, the so-called inter-aural time delay or ITD. For sounds originating in front of or behind the listener the ITD value is relatively small. A large body of literature describes numerous such cues and their interpretation in detail.

Human listeners are further sensitive to the location of reflectors. Sound from a given emitter may arrive via one or more paths including a path that includes a reflection from a surface. The resulting distribution of arrival delays is a cue to the acoustic environment.

Cues indicating location, motion, and reflective environment may be synthesized to enhance the realism of sound reproduction. Cue synthesis finds application in cinema sound systems, video games, "virtual reality" systems, and multimedia enhancements to personal computers. The existing cue synthesis systems exhibit shortcomings. Some do not generate accurate cues and thus do not effectively simulate an emitter's position. Others introduce unwanted audible artifacts into the sounds to be reproduced.

SUMMARY OF THE INVENTION

The invention provides a digital audio spatialization system that incorporates accurate synthesis of three-dimensional audio spatialization cues responsive to a desired simulated location and/or velocity of one or more emitters relative to a sound receiver. In one embodiment, cue synthesis simulates the location of one or more reflective surfaces in the receiver's simulated acoustic environment. The cue synthesis techniques of the invention are suitable for economical implementation in a personal computer add-on card.

In accordance with one aspect of the invention, feedback control is applied to adjust a time delay between sound generating devices corresponding to a right and left channel.

A desired azimuth and elevation of an emitter are determined. The spatialization system calculates a target inter-aural time delay (ITD) that would effectively simulate the desired emitter location. Feedback control then regulates the ITD to the target value. Thus, unlike in the prior art, errors in calculating phases of the right and left channel do not accumulate over time causing an emitter to appear to be in the wrong location.

One embodiment develops ITD by passing digital samples representing a monaural sound waveform through an addressable memory, wherein each memory address corresponds to a particular sample of the waveform. As herein defined, positions within the waveform are considered to be identified by "phase" values, whether or not the waveform is sinusoidal or periodic. Separate phase registers are maintained for a right and left channel with the phase difference therebetween corresponding to the current ITD. To generate a current instantaneous channel amplitude for one of the channels, an integer part of the phase is used to address a particular range of memory cells. The cue synthesis system of the invention may then calculate the current instantaneous channel amplitude by applying high-order interpolation techniques.

Also, in accordance with the invention, the target ITD representing a stationary emitter may be restricted to an integer value. This removes artifacts introduced by crude low-cost interpolation techniques. The resulting restriction on permissible stationary azimuthal positions is not perceptible.

Another aspect of the invention simulates motion of an emitter relative to a receiver by efficiently approximating the Doppler shift corresponding to the emitter's simulated motion. In one embodiment, a Doppler shift ratio is approximated as a multiple of the simulated radial velocity. In another embodiment, the simulated radial velocity is an index to an empirically derived look-up table. In either case, the resulting Doppler shift ratio effectively multiplies by a phase incrementation value. In accordance with a still further aspect of the invention, a further approximation is realized by summing the resulting Doppler shift ration with the phase incrementation value.

Furthermore, another aspect of the invention provides a technique for the simplification of ITD calculations during motion of an emitter. Prior to the emitter's movement, a host processor develops parameters defining the variation in emitter pitch during motion. An envelope generator then uses these parameters to calculate the necessary phases in real time. The host processor is left free for further calculations.

A still further aspect of the invention simulates elevation and azimuth cues by applying a variable frequency and/or notch depth comb filter to the generated sound. Due to the reflective properties of the pinna of the human ear, different filter characteristics are associated with different azimuths and elevations. The characteristics of the comb filter of the invention may be varied in real time to simulate motion. In one embodiment, the comb filter has a special structure that permits rapid notch frequency adjustment.

The invention further provides a simple structure for simulating the presence of multiple emitters in a reflective environment. In accordance with the invention, separate delay lines are provided for the left channel and right channel. Each delay line has a single output. To simulate a particular path from an emitter to the listener, samples from the emitter sum into a point along the delay line separated from the output by a distance corresponding to the path delay. Thus, numerous emitters and paths may be simulated by introducing samples at various points along a single delay line. One embodiment further refines the path delay value by applying interpolation to the delay line inputs. This interpolation can be implemented as linear interpolation, an allpass filter, or other higher-order interpolation techniques.

The invention will be better understood by reference to the following detailed description in connection with the accompanying drawings.

DESCRIPTION OF SPECIFIC EMBODIMENTS

Figure 1A:
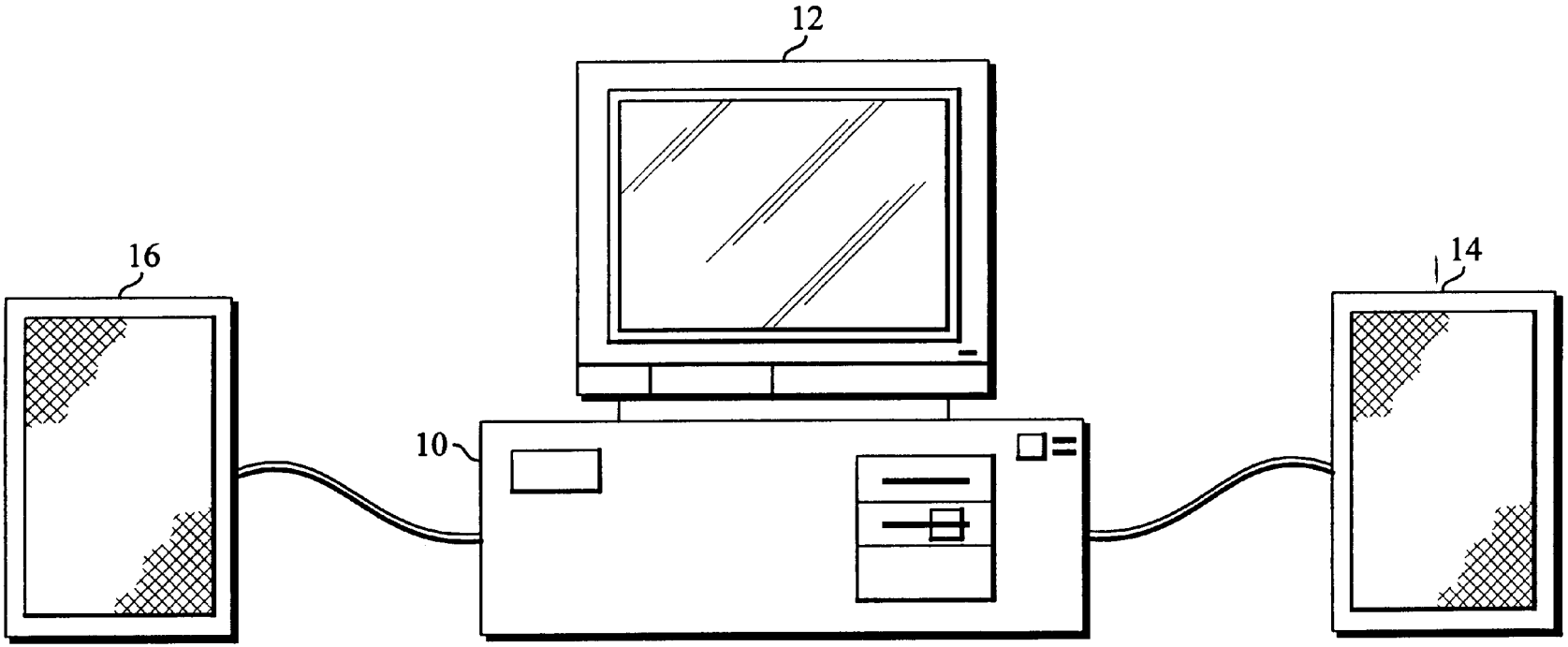
FIG. 1A depicts a representative multimedia personal computer system usable in conjunction with the audio spatialization system of the invention.

The present invention is applicable to digital sound generation systems of all kinds. Three-dimensional audio spatialization capabilities can be provided to video games, multimedia computer systems, virtual reality, cinema sound systems, home theater, and home digital audio systems, for example. FIG. 1A depicts a representative multimedia personal computer 10 with monitor 12 and left and right speakers 14 and 16, an exemplary system that can be enhanced in accordance with the invention with three-dimensional audio.

Figure 1B:
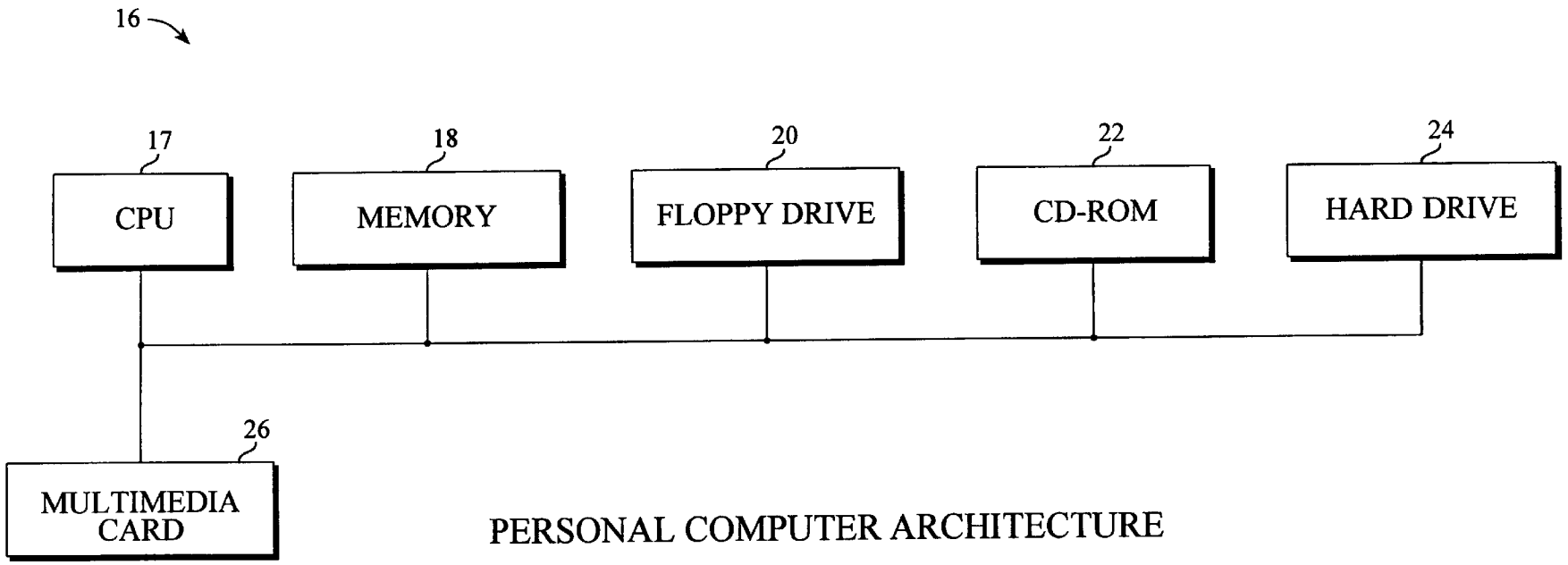
FIG. 1B depicts a simplified representation of the internal architecture of the multimedia personal computer system.

FIG. 1B depicts a greatly simplified representation of the internal architecture of personal computer 10. Personal computer 10 includes a CPU 17, memory 18, a floppy drive 20, a CD-ROM drive 22, a hard drive 24, and a multimedia card 26. Of course, many possible computer configurations could be used with the invention. In fact, the present invention is not limited to the context of personal computers and finds application in video games, cinema sound systems and many other areas.

Figure 2:
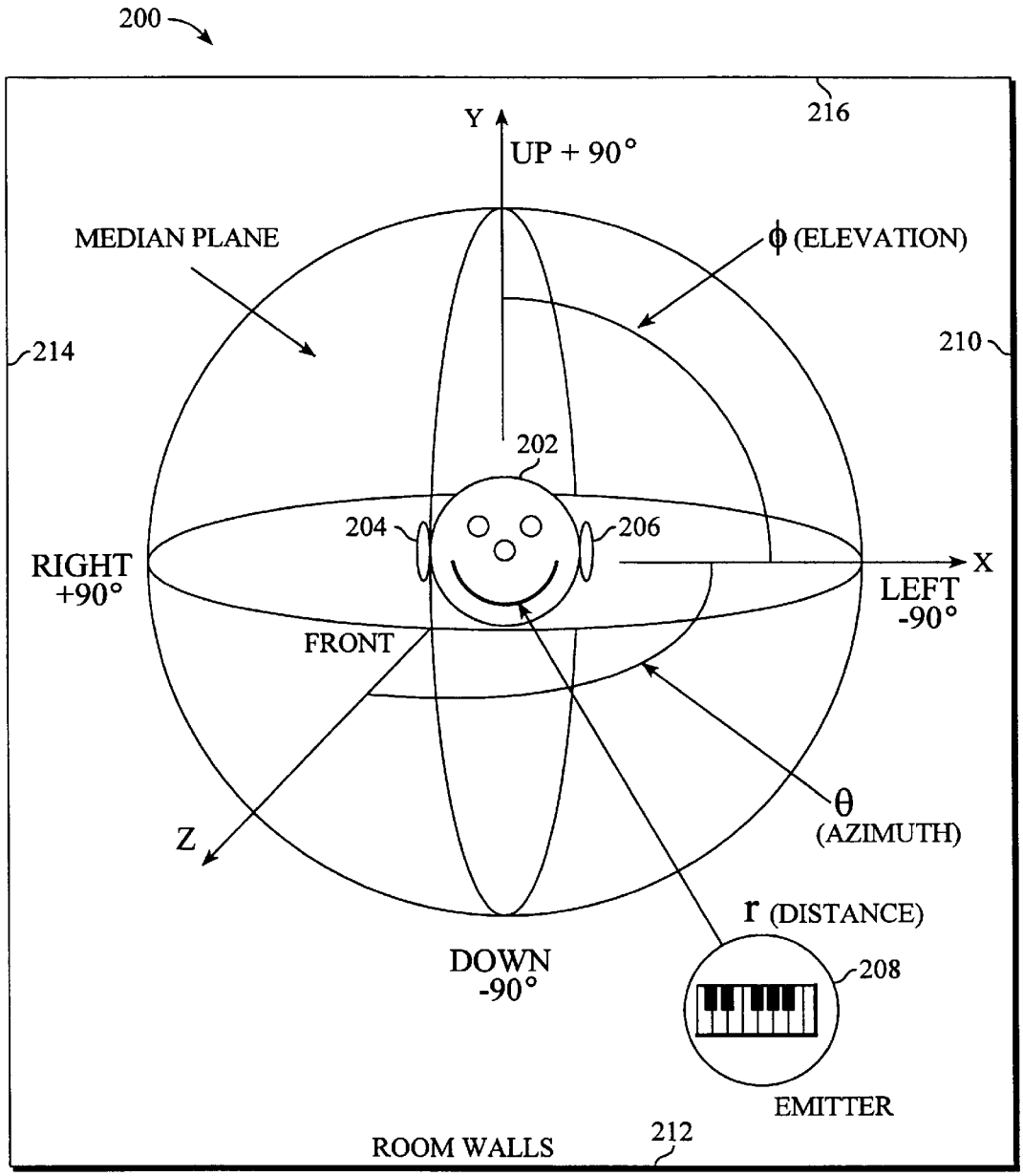
FIG. 2 depicts a simulated acoustic environment.

"Spatialization" is herein defined to mean simulating the location and/or velocity of sound emitters and/or reflective surfaces relative to a sound receiver. FIG. 2 depicts a representative simplified acoustic environment 200 of a listener and is useful for defining other terms to be used in the discussion that follows. A head 202 of the listener is depicted at the origin of an x-y-z coordinate system.

The plane between ears 204 and 206 that bisects the head is defined to be the "median plane." For the listener orientation depicted, the median plane corresponds to the y-z plane but the sound spatialization techniques of the invention can take head rotation into account. A simulated emitter 208 is depicted at a distance from the listener, r. The "azimuth", $\theta$, is the angle about the y-axis. The "elevation", $\phi$, is then the angular altitude relative to the plane defined by the x and z axes. Angles will be given in degrees herein. Room walls 210, 212, 214, and 216 are reflective surfaces of the acoustic environment 200.

Figure 3:
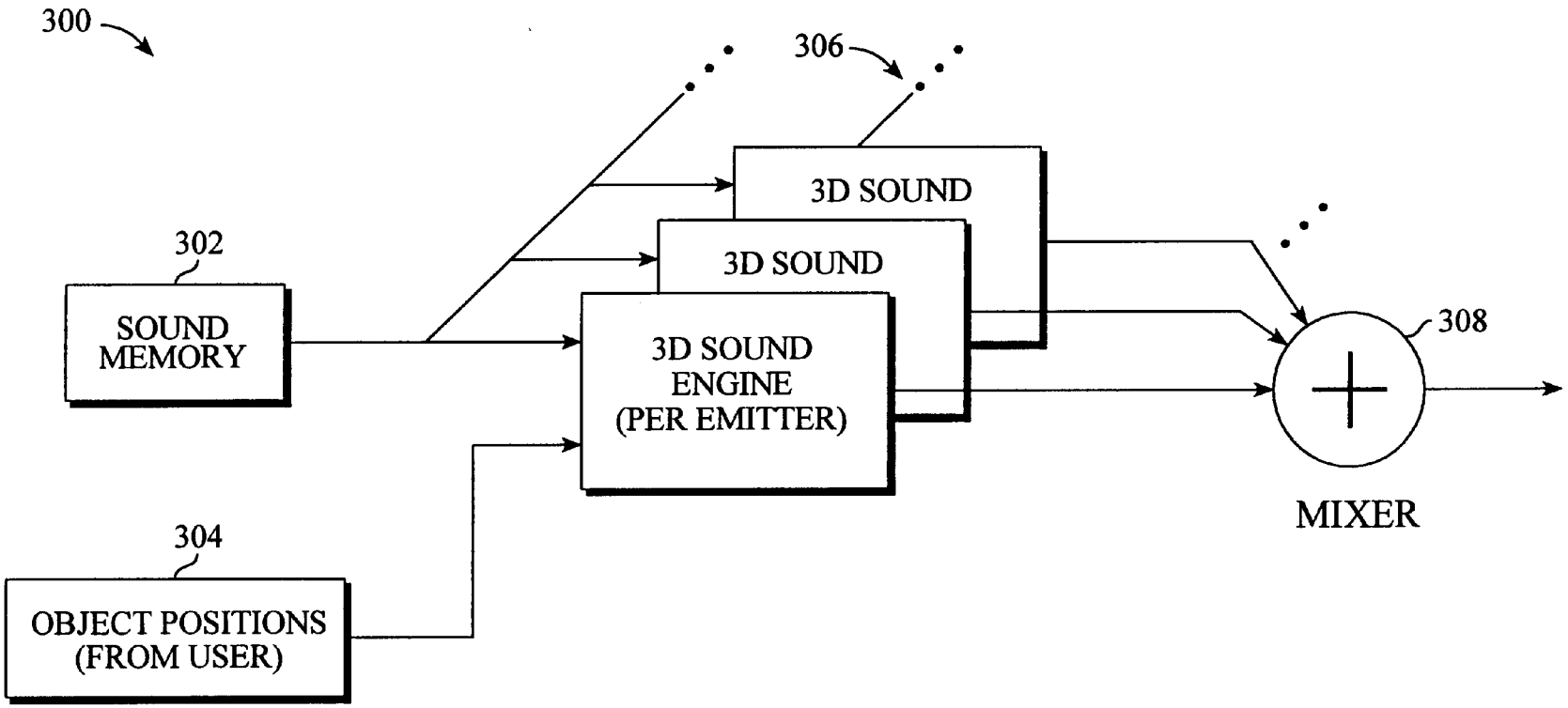
FIG. 3 is a top-level block diagram of a digital sound generation system in accordance with the invention.

FIG. 3 depicts a digital sound generation architecture in accordance with the invention. A digital sound generation system 300 includes a sound memory 302, an acoustic environment definition generator 304, multiple three-dimensional spatialization systems 306 corresponding to individual emitters, and a mixer 308. Sound memory 302 includes digital samples of sounds to be generated or reproduced. These digital sound samples may be derived from any source of samples or synthesized digital audio including e.g., the well-known .wav type files. Alternatively, digital sound samples may be derived from a microphone or some other source. Acoustic environment definition generator 304 represents whatever entity defines the location and velocity of emitters to be simulated and/or the location and orientation of reflective surfaces to be simulated. For example, a video game program may define the locations and/or velocities of sound generating entities. In the preferred embodiment, locations may be defined in either spherical or rectangular coordinates.

Each three-dimensional spatialization engine 306 corresponds to a different emitter whose position and/or velocity are to be simulated. Many spatialization cues require two independently located sound generating devices. Thus, each three-dimension spatialization engine 306 generally has separate right and left channels. Of course, it would be possible within the scope of the invention to make use of only spatialization cues that do not require distinct right and left channels.

With appropriate modifications, the techniques of the invention could also be applied to digital sound reproduction system that make use of more than two speakers. For example, a separate monaural subwoofer channel could be provided that would be independent of ITD and Doppler cues.

Mixer 308 represents the combination of multiple emitter outputs into single right and left channel signals or a single monaural signal. In the preferred embodiment, the summation is performed digitally, but analog summation is also possible. If a reflective environment is to be simulated, the outputs of the various emitters may be combined in a different way. The left and right channel outputs are eventually converted to analog and reproduced through separate speakers or through headphones.

The components of digital sound generation architecture 300 may be implemented as any combination of hardware and software. Functionality may also be divided between multiple processors with some functions assigned e.g. to a main processor of a personal computer, and others to a specialized DSP processor on an add-on card.

Figure 4:
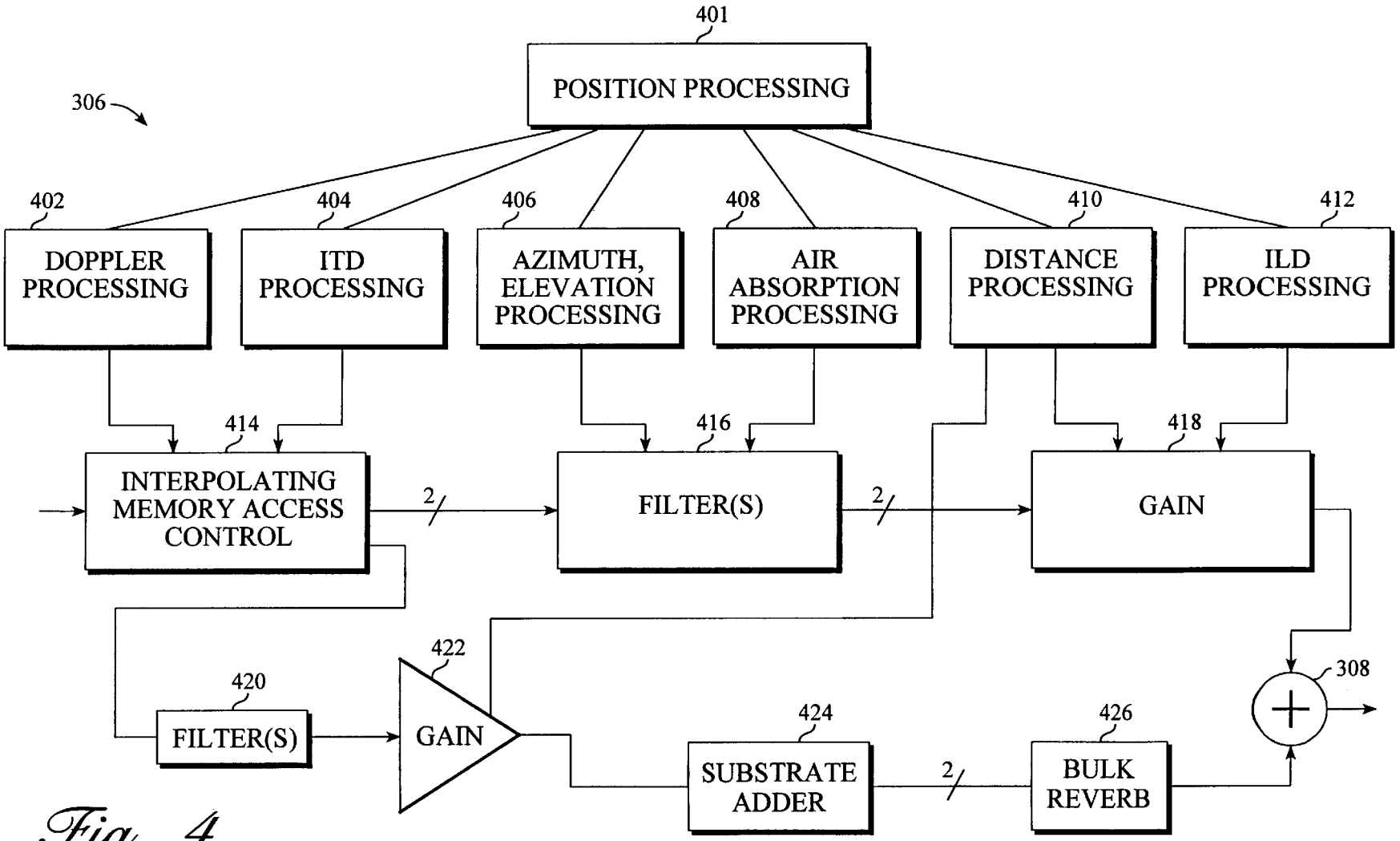
FIG. 4 is a top-level block diagram of a spatialization cue synthesis system in accordance with the invention.

FIG. 4 depicts a single three-dimensional audio spatialization system 306. Three-dimensional audio spatialization system 306 includes various subsystems that synthesize various distance, velocity, and reflection cues responsive to information received from acoustic environment definition generator 304. A position processing unit 401 determines an elevation, azimuth and radial distance of the emitter given its x-y-z coordinates. A Doppler processing unit 402 determines a pitch shift ratio responsive to a relative radial velocity of the emitter. An interaural time delay (ITD) processing unit 404 determines from the emitter elevation and azimuth an ITD value that simulates the difference in time delay perceived between each ear. An azimuth/elevation processing unit 406 calculates filter parameters that simulate head shadowing and pinna reflection off the ear. An air absorption processing unit 408 calculates filter parameters that simulate the effects of air absorption between the emitter and listener. A distance processing unit 410 calculates the frequency-independent attenuation that would simulate the distance between the emitter and receiver. An interaural level difference processing unit (ILD) 412 calculates gains applied separately to each channel. The relationship of these gains simulates the perceived volume difference between ears that depends on emitter location.

Actually applying the cue information generated by the above-identified units is the function of the remaining blocks of FIG. 4. An interpolating/memory access control unit 414 uses input from sound memory 302 to produce instantaneous amplitudes for the left and right channel taking into account the Doppler and ITD cues calculated by Doppler processing unit 402 and ITD processing unit 404. In the preferred embodiment, interpolating/memory access control unit 414 further develops a third instantaneous channel amplitude that is used for reverberation.

A first filter unit 416 shapes the spectrum of the right and left channels under the control of azimuth/elevation processing unit 406 and the air absorption processing unit 408.

Gain unit 418 has a simple structure with individual amplifiers for the left and right channels, each with variable gain. In the preferred embodiment, these gains are adjusted in tandem to provide a distance cue under the control of distance processing unit 410 and separately to provide an interaural level difference (ILD) cue, under the control of ILD processing unit 412.

A second filter unit 420 similarly shapes the spectrum of the interpolation channel under the control of azimuth/elevation processing unit 406 and/or air absorption processing unit 408 (interconnections to second filter unit not shown for simplicity).

A gain unit 422 coupled to the output of second filter unit 420 provides a gain to the reverberation channel. This gain provides a further distance cue responsive to distance processing unit 410. Further emitters will have higher reverberation channel gains since a higher percentage of sound energy will arrive via a reflective path.

In accordance with one embodiment of the invention, a so-called substitution adder 424 simulates reflections corresponding to transit durations of less than 80 milliseconds. The detailed structure of substitution adder 424 is set forth in reference to FIGS. 8A–8B. A bulk reverberator 426 constructed in accordance with well-known prior art techniques simulates reflections corresponding to transit durations of greater than 80 milliseconds. A description of the internal structure of bulk reverberator 426 can be found in J. A Moorer, "About This Reverberation Business," In C. Roads and J. Strawn (Eds.), *Foundations of Computer Music,* (MIT Press, Cambridge, Mass. 1985), the contents of which are herein incorporated by reference. In the preferred embodiment, substitution adder 424 and bulk reverberator 426 are shared among many emitters. The output of gain unit 418 and bulk reverberator 426 are summed into mixer 308.

In one embodiment, the calculation of cue information by Doppler processing unit 402, ITD processing unit 404, azimuth elevation processing unit 406, air absorption processing unit 408, distance processing unit 410, and ILD processing unit 412, is performed by the CPU 17 of multimedia personal computer 10. The multimedia add-on card 26 performs the functions of interpolating/memory access control unit 414, filter unit 416, gain unit 418, and reverberation unit 420. In an alternative embodiment, nearly all the calculations are performed by a special DSP processor resident on multimedia card 26. Of course, this functionality could be divided in any way or could be performed by other hardware/software combinations.

Figure 5A:
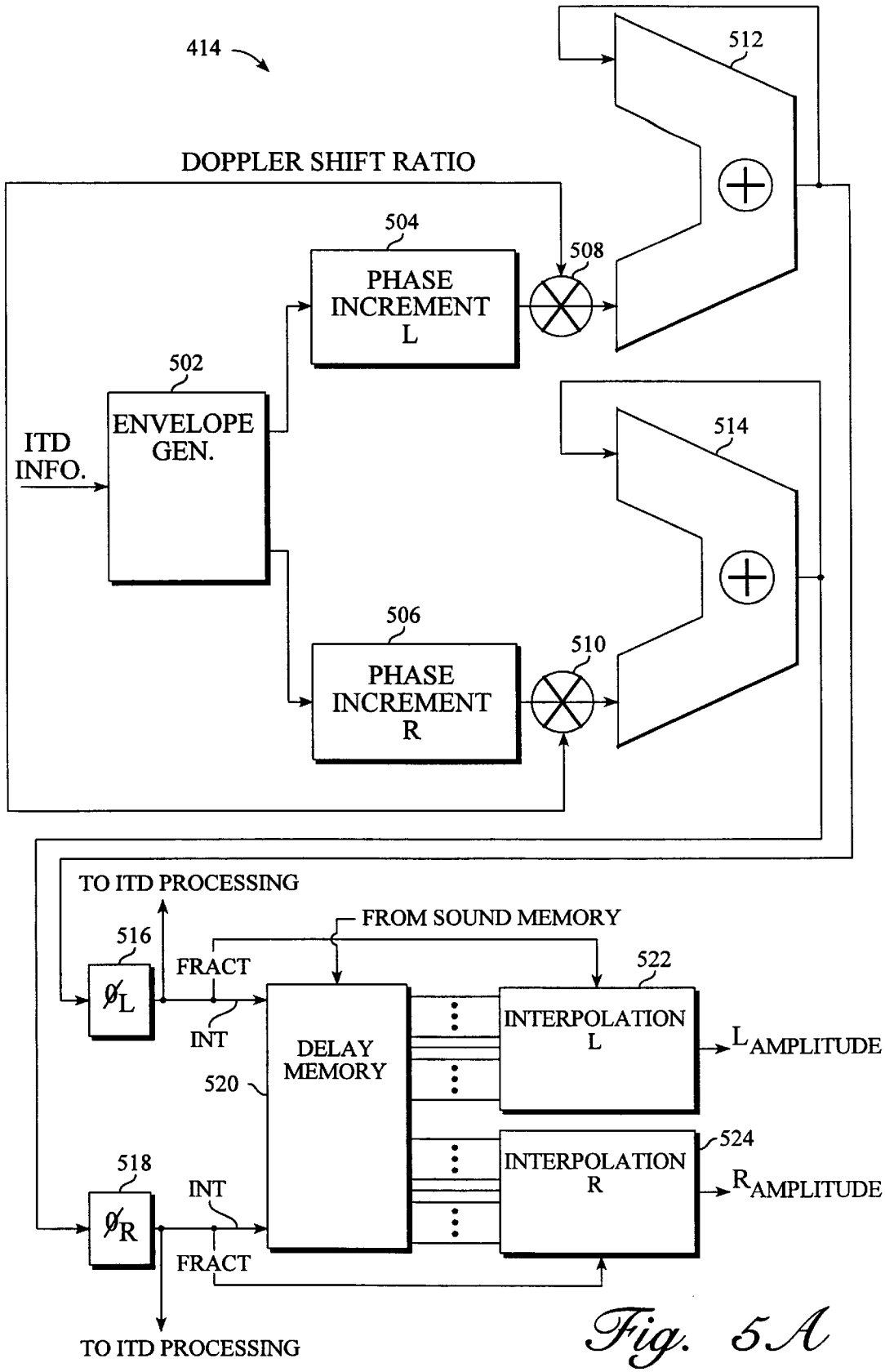
FIGS. 5A–5B depict an interpolating/memory control unit in accordance with the invention.

FIG. 5A depicts the structure of interpolating/memory access control unit 414 in accordance with one embodiment of the present invention. Interpolating/memory access control unit 414 includes an envelope generator 502, a left phase increment register 504, a right phase increment register 506, a left Doppler shift multiplier 508, a right Doppler shift multiplier 510, a left phase accumulator 512, a right phase accumulator 514, a left phase register 516, a right phase register 518, a delay memory 520, a left interpolation unit 522, and a right interpolation unit 524.

As used herein, the term "phase" refers to the integral and fractional position within a sequence of digital samples. The sequence need not be a sinusoid or be periodic.

The current right and left phase increment values as stored in left phase increment register 504 and right phase increment register 506 are a function of the current ITD value developed by ITD processing unit 404 in conjunction with envelope generator 502. These phase increments are multiplied by the current Doppler shift ratio determined by Doppler shift processing unit 504. Left phase accumulator 512 and right phase accumulator 514 accumulate the phases independently for the right and left channels. In the preferred embodiment, a single time-shared accumulator implements left phase accumulator 512 and right phase accumulator are Left phase register 516 and right phase register 518 maintain the accumulated phases for each channel.

Delay memory 520 stores a sequence of digital samples corresponding to the sound to be generated by a particular emitter. The samples may be derived from any source. In one embodiment, delay memory 520 is periodically parallel loaded. In another embodiment, delay memory 520 is continuously loaded with a write pointer identifying the current address or phase to be updated.

The integer portion of the right and left phases serve as address signals to delay memory 520. In the preferred embodiment, interpolation is used to approximate amplitudes corresponding to the right and left phases. Therefore left and right interpolation units 522 and 524 each process two or more samples from delay memory 520, the samples being identified by the appropriate address signals. The interpolation units 522 and 524 interpolate in accordance with any one of a variety of interpolation techniques as will be described below with reference to FIGS. 6A–6B. The outputs of the interpolation units 522 and 524 are left and right channel amplitude signals.

Figure 5B:
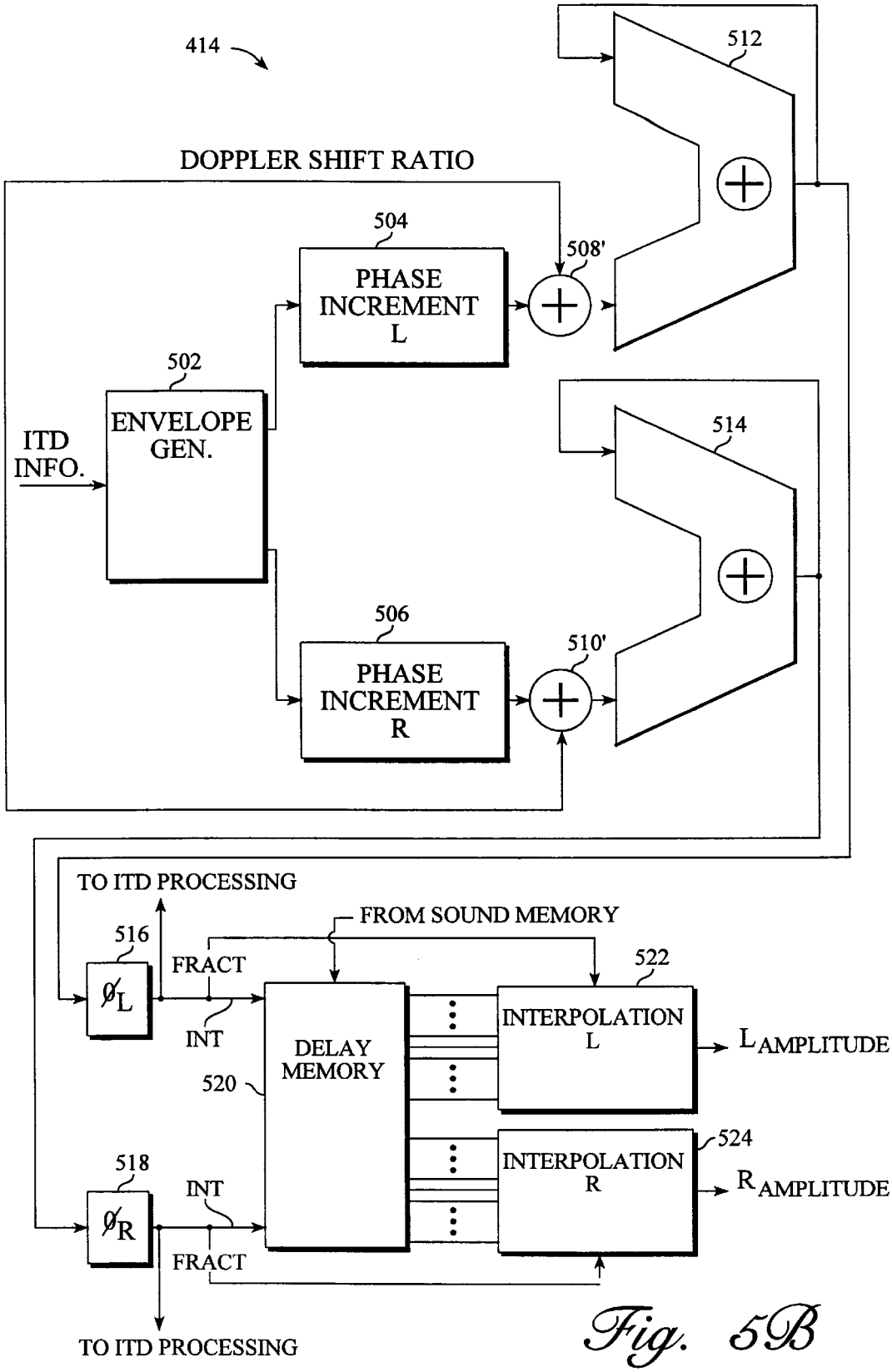

FIG. 5B depicts the structure of interpolating/memory control unit 414 in accordance with an alternative embodiment of the invention. The embodiment depicted in FIG. 5B is substantially similar to the embodiment of FIG. 5A. Instead of Doppler shift multipliers 508 and 510, summers 508' and 510' are provided. As will be explained with reference to FIG. 13, the Doppler shift can then be approximated by adding a Doppler shift term to the current phase increment.

In the preferred embodiment, interpolating/memory control unit 414 further generates a reverberation channel. Accordingly, there is a third phase accumulator (not shown), third Doppler shift multiplier and/or adder, a third phase register, and a third interpolator. A Doppler shift may be applied to the reverberation channel but ITD may not be applied.

Figure 6A:
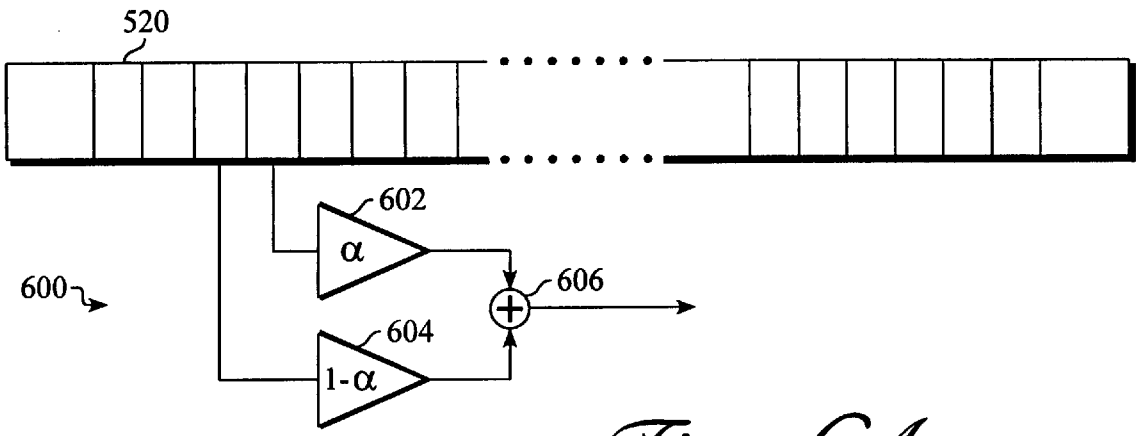
FIGS. 6A–6B depict interpolation architectures for interpolating instantaneous left and right channel amplitudes in accordance with the invention.
Figure 6B:
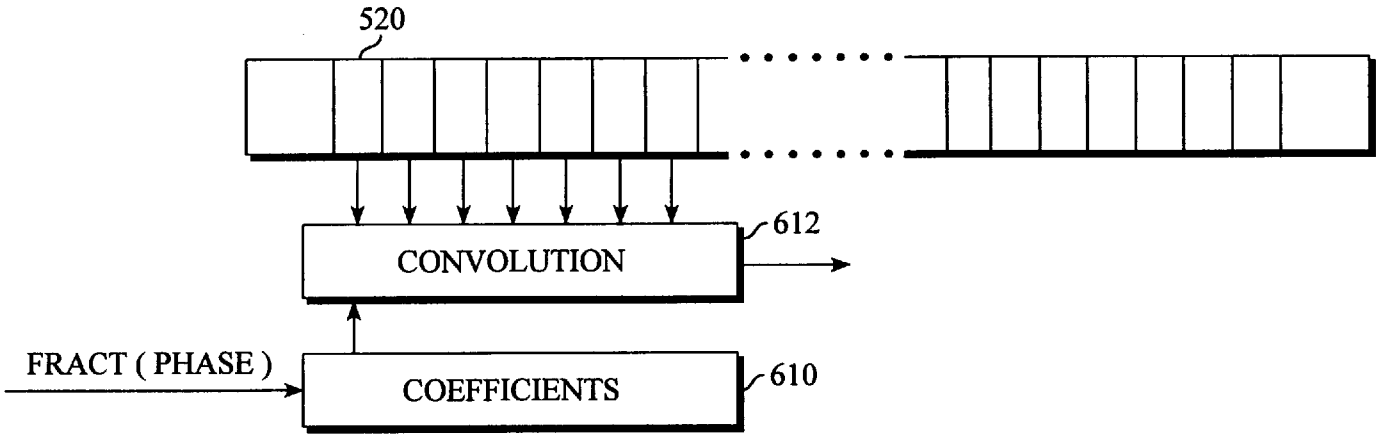

FIGS. 6A–6B depict various interpolation techniques used in conjunction with delay memory 520 in accordance with the invention. FIG. 6A shows a linear interpolator 600 that corresponds to either left interpolation unit 522 or right interpolation unit 524. The linear interpolator includes a first gain stage 602 with gain $\alpha$ and a second parallel gain stage 604 with gain 1-$\alpha$. The first gain stage obtains its input from the memory address identified by the integer phase. The second parallel gain stage obtains its input from the next memory address. The parameter $\alpha$ corresponds to the fractional part of phase. The output of a summer 606 then represents an amplitude linearly interpolated between these two memory addresses.

FIG. 6B shows a higher-order interpolator 608 including a coefficient memory 610 and a convolution unit 612. The integer part of the phase determines the center of a range of memory addresses from which convolution unit 612 draws input. In the preferred embodiment, the actual integer address identifies the start of the range and an offset to the center is assumed. The digital samples obtained from delay memory 520 are then convolved with an interpolation transfer function represented by coefficients stored in coefficient memory 610. One type of transfer function useful for this purpose is a windowed sinc function. Another possible transfer function is a low-pass notch filter with notches at the multiples of the sampling frequency. The use of this transfer function for higher-order interpolation is discussed in detail in U.S. Pat. No. 5,111,727 issued to Rossum and assigned to E-Mu Systems, a fully owned subsidiary of the assignee of the present application. The contents of this patent are herein incorporated by reference. For either kind of transfer function, the exact shape of the transfer function and therefore the coefficients are determined by the fractional part of the phase. The convolution output then represents the interpolated channel amplitude.

Another mode of interpolation is to use an all-pass filter. An input of the all-pass filter would be coupled to a delay memory location identified by the integer portion of phase. The fractional part of phase then determines a variable delay through the allpass filter that provides interpolation without introducing amplitude distortion.

Note that it would be possible within the scope of the invention to provide interpolation on one channel only and restrict phases of the non-interpolated channel to have integer phases only. This technique could effectively provide an ITD cue but not a Doppler cue.

Figure 7A:
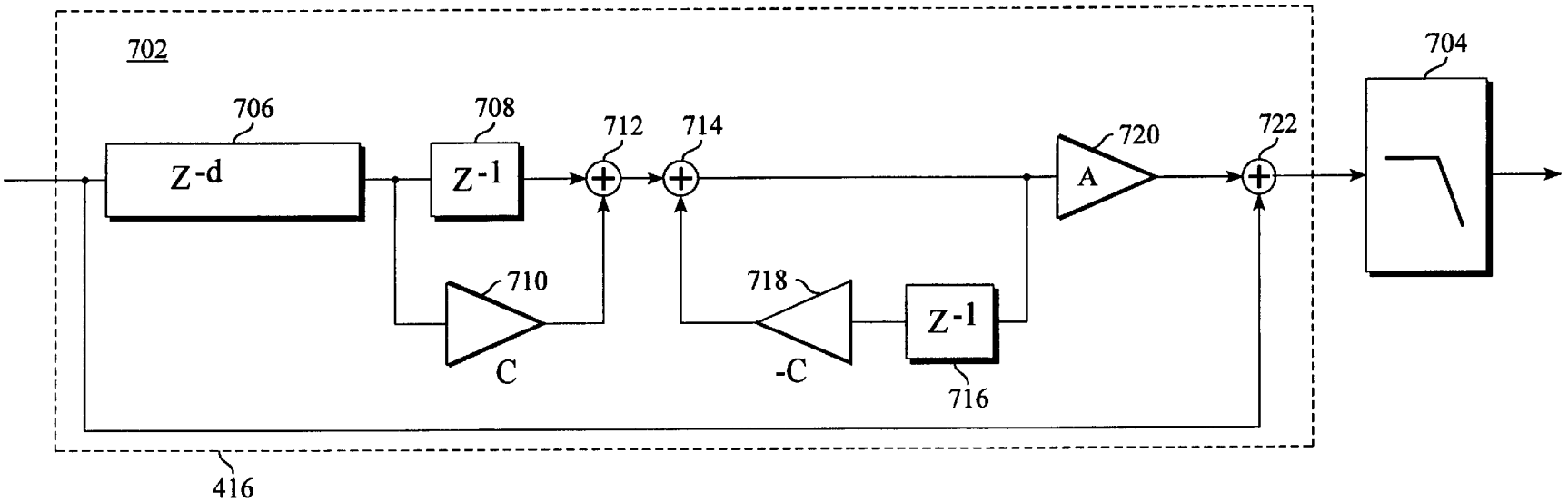
FIGS. 7A–7B depict a filter unit for providing various spatialization cues in accordance with the invention.

FIG. 7A depicts filter unit 416 in accordance with a preferred embodiment of the invention. Filter unit 416 adds cues that simulate the effects of air absorption, shadowing of sounds by the head, and reflections from the pinna of the ear. Filter unit 416 includes a comb filter 702 and a lowpass filter 704. The ordering of the stages may of course be reversed. In the preferred embodiment, the depicted filters are duplicated for the right and left channels.

The frequency and depth of comb filter 702 are varied in accordance with the invention responsive to the desired elevation and azimuth of the simulated emitter to model head shadowing and pinna reflection effects. The operation of comb filter 702 also improves so-called "externalization" when headphones are used as sound generating devices. Poor "externalization" will cause sounds to appear to the listener to originate within the head.

Comb filter 702 includes a first delay stage 706 that delays samples of the output of interpolation/memory control unit 414 by a variable integer, d, sampling periods. A second delay stage 708 delays the output of first delay stage 706 by a single sample period. A first gain stage 710 amplifies by a factor C. A first summer 712 sums the output of second delay stage 708 with the output of first gain stage 708. A second summer 714 receives one input from the output of first summer 712. A third delay stage 716 amplifies the output of second summer 714. A second gain stage 718 amplifies the output of third delay stage 716 by −C and provides a second input to second summer 714. The above-described components of comb filter 702 together constitute an all-pass filter that implements delay having an integer part d and a fractional part that depends on C. Fractional delay could also be implemented as an interpolator as shown in FIGS. 6A–6B.

The output of second summer 714 is also an input to a third gain stage 720 that amplifies by A. A third summer 722 sums the output of third gain stage 720 with samples input to first delay stage 706. The output of third summer 722 is the comb filter output.

Figure 7B:
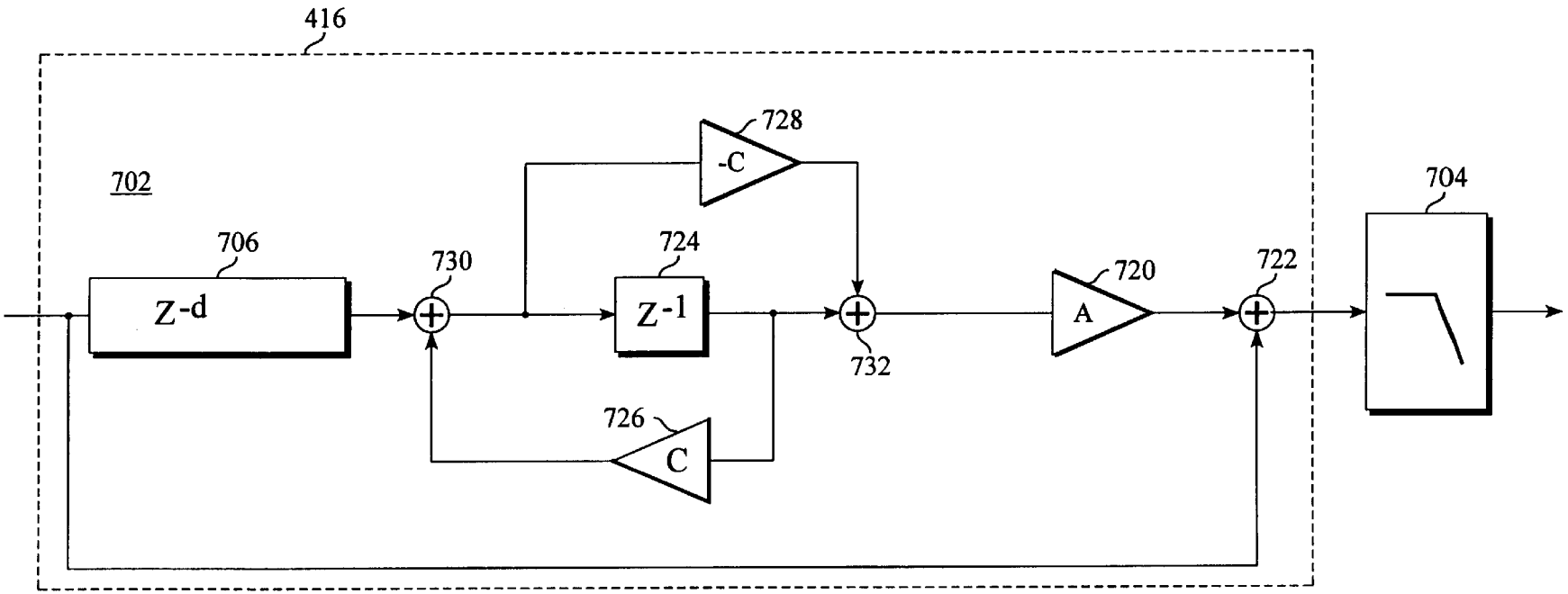

FIG. 7B depicts filter unit 414 in accordance with an alternative embodiment of the invention. The structure is similar to that depicted in FIG. 7A except that a second delay stage 724 is shared between a first gain stage 726 and a second gain stage 728 within comb filter 702. A first summer 730 receives a first input from first delay stage 706. The output of first summer 730 is an input to second delay stage 724 and to second gain stage 728 having gain −C. A second summer 732 receives inputs from second delay stage 724 and second gain stage 728. First gain stage 726 has gain C and receives an input from second delay stage 724 and has its output coupled to a second input of first summer 730. The output of second summer 732 is then an input to third gain stage 720. The remainder of the structure of filter unit 414 is as depicted in FIG. 7A.

The parameters d and C are fully variable in accordance with the invention and set the first notch frequency of the comb filter to provide cues of elevation and azimuth. The parameter A may also be variable and sets the notch depth.

The comb filter of the invention, particularly as depicted in FIG. 7A provides significant advantages over prior art cue synthesizing comb filters. Many prior art comb filters used for this application provide include only integer delay lines without an allpass section. This approach causes unwanted pops and clicks in the audio output. A somewhat more sophisticated prior art approach is augment the integer delay line with a two point linear interpolator. This simple kind of interpolator however results in an undesirable roll-off of the comb filter response and a loss of notch depth.

An advantage of the embodiment of FIG. 7A over FIG. 7B is simplicity in implementing variable delay within the allpass section of comb filter 702. Recall that the integer portion of delay is set by d and the fractional part is set by parameter C. First and second delay stages 706 and 708 effectively represent a single delay line of variable length with taps at the end and one stage prior to the end. If cue synthesis for a moving emitter requires d to be decreased during sound generation, there is no need to move the contents of second delay stage 708 into first delay stage 706. Instead, the two taps are moved along the single delay line.

In the preferred embodiment, lowpass filter 704 has two poles and is implemented as an IIR filter with externally adjustable coefficients. The details of the internal structure of lowpass filter 704 are described in U.S. Pat. No. 5,170,369 issued to Rossum and assigned to E-mu Systems Incorporate, a wholly owned subsidiary of the assignee of the present application. The 3 dB frequency of lowpass filter 704 is variable responsive to elevation and azimuth to model head shadowing effects. The 3 dB frequency is also variable responsive to distance between emitter and receiver to model air absorption effects.

Filter unit 420 in the reverberation path may be substantially similar to filter unit 416. In the preferred embodiment, only lowpass filter 704 is implemented within filter unit 420 without a comb filter. The parameters of lowpass filter 704 may be adjusted to provide a cue simulating the reflective properties of reflective surfaces within the listener's simulated acoustic environment.

Figure 8A:
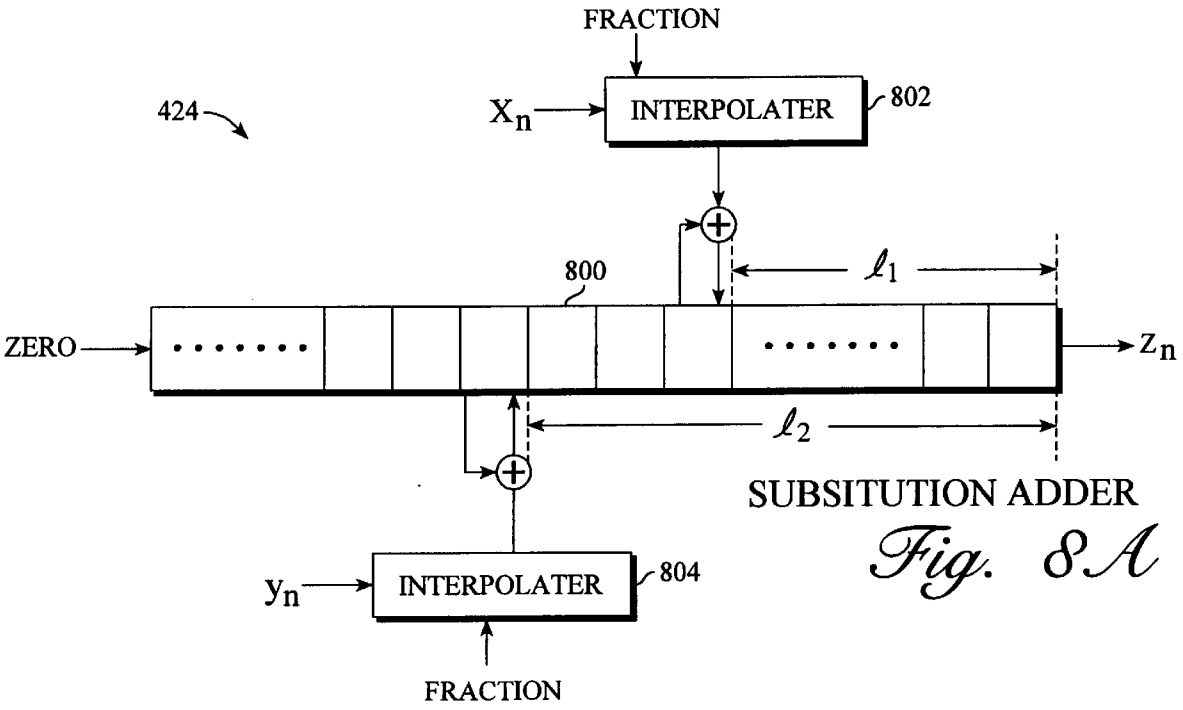
FIGS. 8A–8B depict a substitution adder in accordance with the invention.

FIG. 8A depicts a portion of substitution adder 424 in accordance with one embodiment of the invention. Substitution adder 424 includes a delay line 800 with interpolators 802 and 804 corresponding to individual emitters. The depicted structure is essentially repeated for both the left and right channels. The substitution adder structure of the invention will accommodate an arbitrary number of emitters with only two delay lines. Thus substitution adder 802 is shared among multiple spatialization systems of FIG. 3.

In accordance with the invention, delay line 800 is equipped with a single output. The preferred embodiment selects a path length for a particular emitter by summing samples from the emitter at an appropriate location along delay line 800. Thus, in FIG. 8A samples from emitter x are subject to a path length of $l_1$ and samples from emitter y are subject to a path length of $l_2$.

Of course, samples from a single emitter may travel over more than one reflective path and thus may be inserted at more than one location. In accordance with the invention, the amplitudes transmitted along various paths employed by a single emitter may be varied to provide a further distance cue.

In accordance with the invention, an integer portion of the path length as measured in units of delay may be simulated by selecting an appropriate insertion point along delay line 800. A fractional portion of the delay length is simulated by interpolators 802 and 804.

Interpolators 802 and 804 may have any of the structures shown in FIGS. 6A–6B used to develop the left and right channel amplitudes or any other appropriate structure. However, the interpolators 802 and 804 obtain their inputs from the emitter sample streams. Interpolators 802 and 804 incorporate a small internal sample cache to provide the necessary range of input samples. Another alternative structure for interpolators 802 and 804 would be an allpass filter structure of the kinds found in comb filter 702 of FIGS. 7A–7B.

The structure depicted in FIG. 8A provides important advantages in that only two delay lines are needed to provide reflections to right and left channels for an arbitrary number of emitters. In the prior art, each emitter would require a separate delay line.

In accordance with one embodiment of the invention, path lengths are varied slightly between the left and right channel delay line to simulate ITD and the orientation of reflectors. Thus for each propagation path of an emitter, two separate path delays are calculated and implemented, corresponding to the delay to each ear.

Figure 8B:
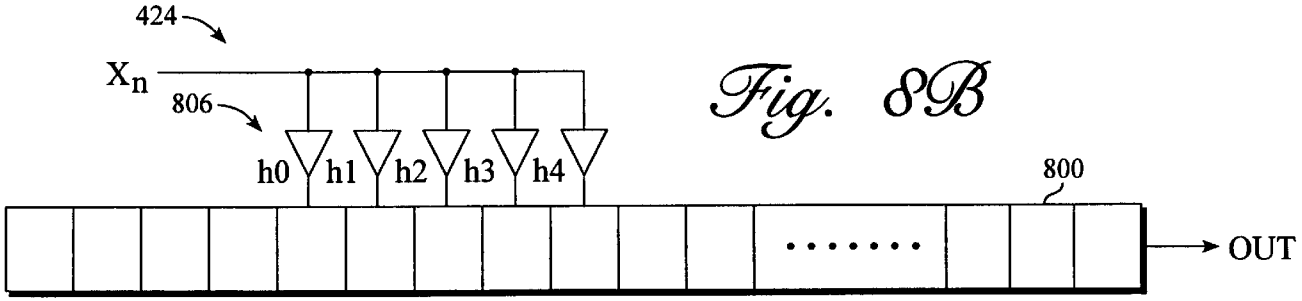

FIG. 8B depicts a portion of substitution adder 424 in accordance with an alternative embodiment of the invention. FIG. 8B depicts an alternative interpolation scheme for implementing fractional path delays in accordance with the invention. This embodiment does not employ interpolators that include a sample cache. Instead, emitter samples are fed in parallel into a series of locations along delay line 800. An integer portion of the desired path delay determines the range of locations. A fractional portion of the desired path delay determines individual coefficients to multiply with the input to different locations. The coefficients determine an interpolation transfer function of the kind discussed in reference to FIG. 6B. Gain stages 806 multiply the coefficients by the input to each location. It is understood that like in FIG. 8A, each input is summed with the output of the previous delay lines stages.

Figure 9:
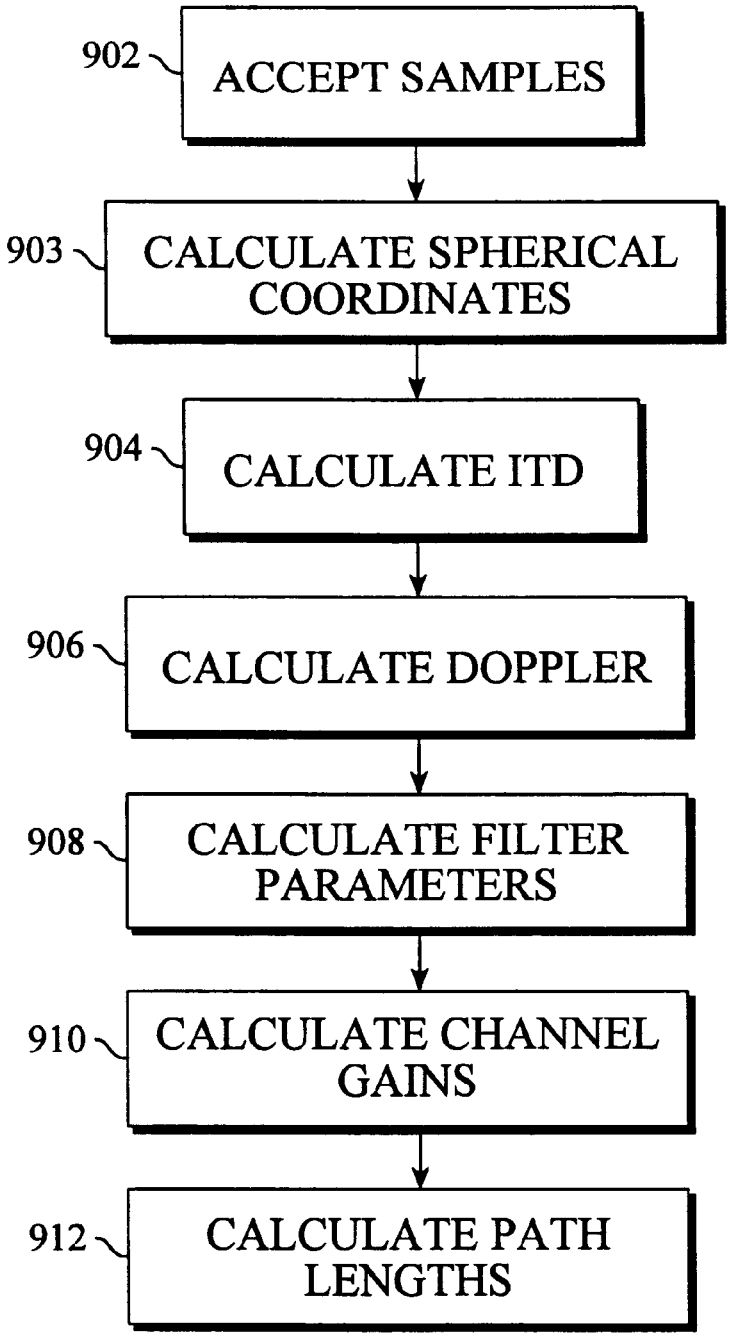
FIG. 9 is a top-level flowchart describing the steps of developing audio spatialization cues in accordance with the invention.

FIG. 9 is a top-level flowchart describing the steps of generating sound spatialization cues for a single emitter in accordance with one embodiment of the invention. At step 902, a frame of 128 digital monaural sound samples are accepted into delay memory 520. At step 903, position processing unit 401 determines the desired azimuth, elevation, and radius of the emitter given its x-y-z coordinates.

For simulated emitter locations having elevation equal to zero, the preferred embodiment uses a special approximation to the arctangent of z/x to determine the azimuth. The approximation is: $\Theta=90*|z|/(|x|+|z|)$ and saves considerable calculation time. Of course, step 903 is unnecessary if emitter location information is already available in spherical coordinates.

At step 904, ITD processing unit calculates a new ITD value. At step 906, Doppler processing unit 402 calculates a pitch shift ratio corresponding to the velocity of the emitter. At step 908, azimuth/elevation processing unit 406 and air absorption processing unit 408 determine the parameters of comb filter 702 and lowpass filter 704. At step 910, distance processing unit 410 and ILD processing unit 412 calculate new gains for each channel. At step 912, distance processing unit 410 calculates the different path lengths for the emitter in accordance with any simulated reflective surfaces.

In an alternative embodiment, samples are loaded into delay memory 520 at arbitrary times. Position information and cues are updated periodically at a rate appropriate to the application. Thus, the steps of FIG. 9 do not occur synchronously.

Figure 10:
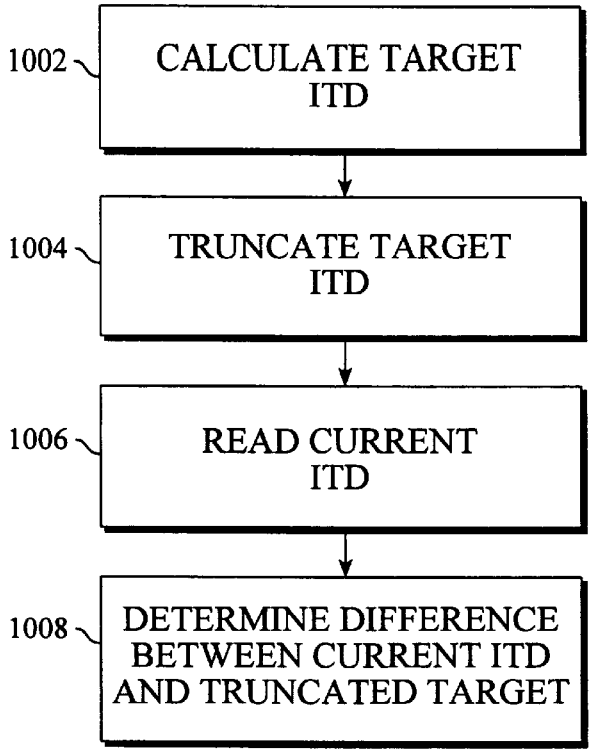
FIG. 10 is a flowchart describing the steps of calculating ITD in accordance with the invention.

FIG. 10 is a flowchart describing the steps of determining ITD for a given group of samples in accordance with the invention. At step 1002, the target ITD is determined by the formula:

$$\text{Target } ITD = \frac{90 - |\text{elevation}|}{90} * \frac{\text{azimuth}}{90} * 1400\ \mu\text{sec.}$$

Although the maximum perceived ITD is 700 $\mu$sec, it has been found that exaggerating the maximum simulated ITD to 1400 $\mu$sec enhances the realism of spatialization. Of course, some other formula could also be used to calculate ITD.

Figure 11:
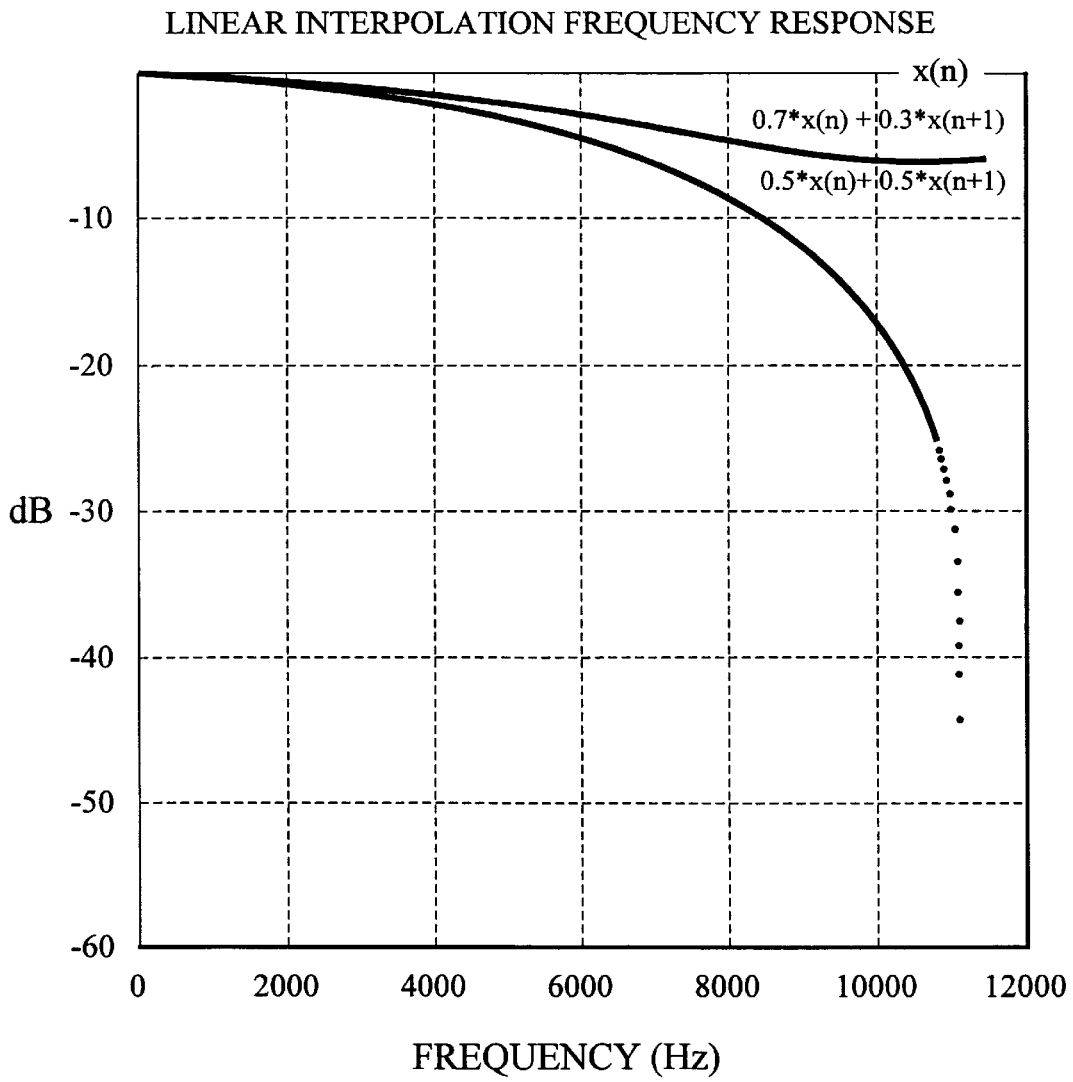
FIG. 11 depict a response showing how a frequency roll-off is caused by the ITD calculation techniques of the prior art.

At step 1004, in accordance with one embodiment of the invention, the target ITD value is truncated so that it corresponds to an integer phase difference between the right and left channels. This step provides the invention with important advantages in that no interpolation artifacts appear for stationary emitters or emitters that do not move azimuthally. FIG. 11 shows the high frequency rolloff resulting from the prior art operation of an interpolator on a stationary emitters. These artifacts are not perceptible for moving emitters.

This restriction on allowed stationary ITD values restricts the number of possible perceived positions. However, in the preferred embodiment, each azimuthal position is simulated to a resolution of approximately 4 degrees which has been found to be near the limit of human perception.

At step 1006, the ITD calculating procedure reads the current ITD by subtracting the contents of left phase register 516 from right phase register 518. At step 1008, the difference between the current ITD and target ITD is calculated.

In one embodiment, the current ITD is adjusted toward the target ITD in 128 increments, corresponding to each sample period in a frame of 128 samples. The large number of increments prevents audible clicks in the output. The phase of either the left or the right channel may be advanced to achieve the required per-sample ITD shift. The necessary per-sample ITD shift is calculated and added to the appropriate phase increment register.

Figure 12:
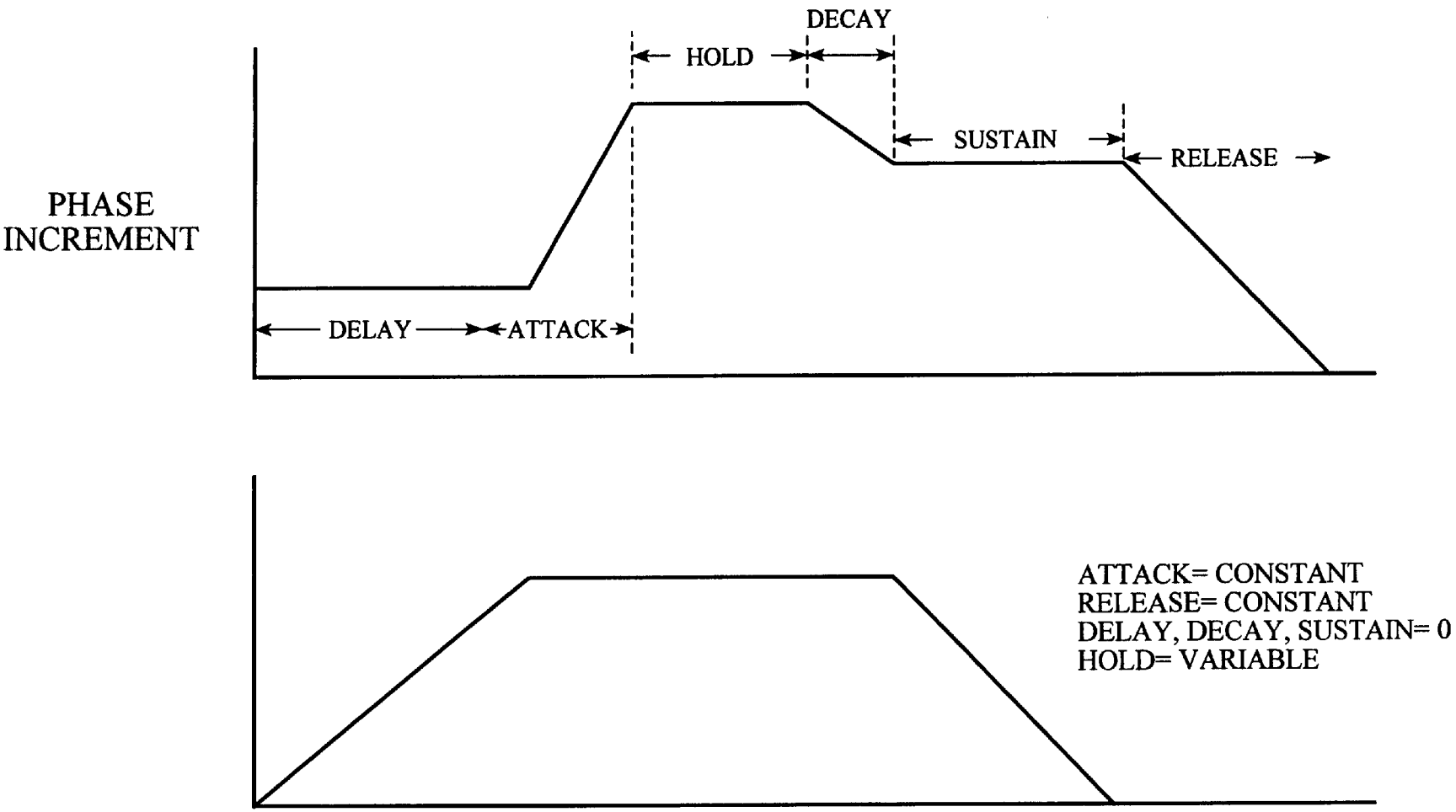
FIG. 12 depicts the operation of an envelope generator in accordance with the invention.

In an alternative embodiment, envelope generator 502 insures a smooth variation of ITD over the frame. FIG. 12 depicts the functionality of envelope generator 502. Envelope generator 502 is used for sound generation tasks besides spatialization. The inputs to envelope generator 502 are the time parameters "Delay". "Attack", "Hold", "Decay", "Release", and "Sustain Level" which define the envelope shape of FIG. 12. For ITD applications, the alternative embodiment provides that the "Attack" and "Decay" times are constant, the "Hold" parameter is a variable, and the remaining parameters are zero. This embodiment calculates the "Hold" parameter in accordance with the desired ITD change over the frame. The longer the duration defined by the hold parameter, the greater the change in ITD. The output of envelope generator 502 is used to set the contents of either right or left phase increment register, depending on which channel is to be advanced in phase to achieve the desired ITD.

The use of envelope generator 502 frees CPU 17 for other tasks while the ITD is adjusted without further intervention. CPU 17 need only calculate the "Hold parameter" and transmit it to envelope generator 502.

Note that in accordance with the invention, the ITD may be adjusted responsive to a measured difference between the current ITD and the target ITD. This feedback technique provides important advantages in that the simulated emitter position cannot drift from its desired location as a result of accumulated quantization errors, a serious drawback of prior art systems.

Figure 13:
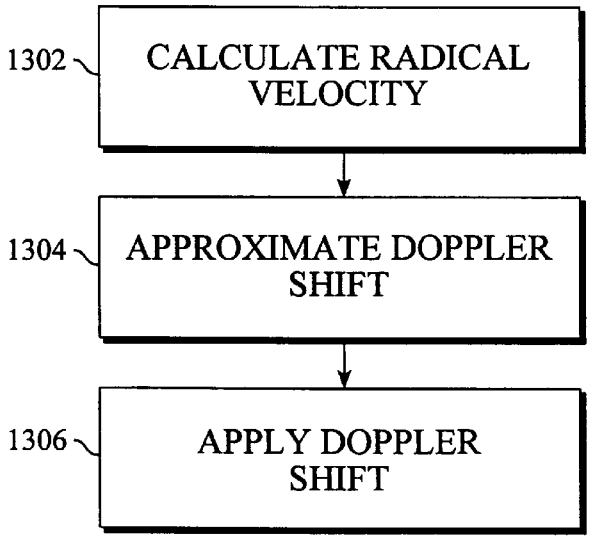
FIG. 13 is a flowchart describing the steps of developing a Doppler shift in accordance with the invention.

FIG. 13 is a flowchart describing the steps of applying a Doppler shift to a simulated emitter in accordance with the invention. At step 1302, Doppler shift processing unit 402 calculates the difference between the target distance and the current distance. This difference represents an estimate of the radial velocity of the emitter. At step 1304, the preferred embodiment approximates the desired Doppler shift by multiplying a constant by this estimated radial velocity. At step 1306, the resulting Doppler shift ratio is input to Doppler shift summers 508' and 510', as shown in FIG. 5B and added to the left and right phase increments stored in left and right phase increment registers 504 and 506. Although strictly speaking the approximated Doppler shifts should be multiplied by the phase increments, summing has been found to be an adequate approximation.

An alternative embodiment employs an empirically-derived look-up table to approximate the Doppler shift from the estimated radial velocity of the emitter. However derived, the estimated Doppler shifts can also be multiplied by the phase increments by Doppler shift multipliers 508 and 510 as shown in FIG. 5A. This multiplication is performed logarithmically as an addition.

Azimuth/elevation processing unit 406 calculates the parameters of comb filter 702 in accordance with an empirically derived table to provide head shadowing and pinna reflection cues. Table 1 gives the first notch frequencies of comb filter 702 for some representative elevation/azimuth combinations. Those of skill in the art will understand how to set the d and C parameters for each desired first notch frequency.

Table 1

Front: 9 kHz
Right: 10 kHz
Rear: 9.5 kHz
Left: 1.3 kHz
Above: 10 kHz
Below: 6 kHz The depth setting, A, may also be varied in real-time responsive to elevation and azimuth. The A values may be derived empirically by moving a real sound emitter around a mannequin and measuring the notch depth in the frequency responses at each ear. A series of A values is then calculated for a series of elevations and azimuths to reproduce the measured notch depths. A technical discussion of the head shadowing and pinna reflections cues is found in Jens Blauert, *Spatial Hearing,* (MIT Press, 1983). The contents of this book are herein incorporated by reference.

For near emitters, azimuth and elevation will largely determine the 3 dB frequency of lowpass filter 704 and the necessary IIR coefficients. Thus the 3 dB frequency will be set by azimuth/elevation processing unit 406. For far emitters, air absorption processing unit 408 will determine the 3 dB frequency and IIR coefficients.

Appendix 1 is a source code listing suitable for implementing one embodiment of the invention, wherein the bulk of functionality is implemented by a DSP on a multimedia card. The source code of Appendix 1 is in the assembly language of the Texas Instruments TMS320C52.

Appendix 2 is a source code listing suitable for implementing an alternative embodiment of the invention, wherein cues are calculated by a host processor and applied to sound generation on a multimedia card. The source code of Appendix 2 is in C and upon compilation may run on the host processor.

While the above is a complete description of the preferred embodiments of the invention, various alternatives, modifications and equivalents may be used. It should be evident that the present invention is equally applicable by making appropriate modifications to the embodiments described above. Therefore, the above description should not be taken as limiting the scope of the invention which is defined by the metes and bounds of the appended claims.

What is claimed is:

1. In a digital sound generation system including a first channel and a second channel, a method for simulating position of a sound emitter relative to a binaural sound receiver comprising the steps of:

calculating a desired inter-channel time delay between an audible output of the first channel and a substantially similar audible output of the second channel responsive to a desired relative position between the sound emitter and the sound receiver;

computing a difference between said desired inter-channel time delay and an actual inter-channel time delay; and modifying said actual inter-channel time delay responsive to said difference.

2. In a digital sound generation system including a first channel and a second channel, a method for simulating motion of a sound emitter relative to a sound receiver comprising the steps of:

calculating a desired inter-channel time delay between an audible output of the first channel and a substantially similar audible output on the second channel responsive to a desired relative position between the sound emitter and the sound receiver;

calculating a parameter representing a variation of said desired inter-channel time delay over time that would simulate said motion;

varying said desired inter-channel time delay in accordance with said parameter; and thereafter computing a difference between said desired inter-channel time delay and an actual inter-channel time delay; and modifying an actual inter-channel time delay responsive to said difference.

3. The method of claim 2 wherein said parameter is the duration of said motion and said step of varying comprises the substep of:

elevating a pitch of one of said first and second channels; and thereafter lowering said pitch of said one of said first and second channels, wherein said duration represents a time between a beginning of said elevating step and an end of said lowering step.

4. In a digital sound generation system including a first channel and a second channel, wherein sound samples for each channel are retrieved from a waveform memory using an address indicative of a current phase, a method for simulating a trajectory of a sound emitter relative to a binaural sound receiver, said trajectory having a beginning point and an end point, comprising the steps of:

determining a target phase of at least one channel of said first channel and said second channel, said target phase corresponding to said end point;

truncating said target phase to an integer value to obtain a truncated target phase; and varying a current phase of said at least one channel until it reaches said truncated target value.

5. In a digital sound generation system wherein sound is represented as a sequence of digital samples and wherein phase is incremented periodically by a phase increment, a method of simulating the Doppler effect of motion of a sound emitter relative to a sound receiver comprising the steps of:

determining a simulated radial velocity of said sound emitter relative to said sound receiver;

calculating a phase increment adjustment responsive to said simulated radial velocity; and multiplying said phase increment adjustment factor by said phase increment.

6. In a digital sound generation system wherein sound is represented as a sequence of digital samples and wherein phase is incremented periodically by a phase increment, a method of simulating the Doppler effect of motion of a sound generator relative to a sound receiver comprising the steps of:

determining a simulated distance that said sound generator would travel in a single incrementation period;

calculating a phase increment adjustment responsive to said simulated distance; and adding said phase increment adjustment factor to said phase increment.

7. In a digital sound generation system wherein sound is represented as a sequence of digital samples and wherein phase is incremented periodically by a phase increment representing a desired pitch, a method of simulating the Doppler effect of motion of a sound emitter relative to a sound receiver comprising the steps of:

determining a simulated radial velocity of said sound emitter relative to said sound receiver;

using said simulated radial velocity as an index to a look-up table to retrieve a phase increment adjustment factor; and multiplying said phase increment adjustment factor by said phase increment.

8. In a digital sound generation system, apparatus for converting a monaural sound stream of digital samples to first channel and second channel amplitudes with a phase difference between said first and second channels simulating an interaural time delay (ITD) corresponding to a simulated position of an emitter relative to a sound receiver, said apparatus comprising:

a first channel phase increment register that stores a first channel phase increment;

a second channel phase increment register that stores a second channel phase increment;

an ITD processor that determines a target ITD value responsive to said simulated position and that adjusts at least one of said first channel phase increment and said second channel phase increment responsive to said target ITD value;

a first channel phase accumulator coupled to said first channel phase increment register that accumulates said first channel phase increment to develop a first channel phase, said first channel phase having integer and fractional components;

a second channel phase accumulator coupled to said second channel phase increment register that accumulates said second channel phase increment;

a delay memory that stores a segment of said digital sound samples; and a first channel high-order interpolator that retrieves samples from one or more locations in said delay memory identified by said integer component of said first channel phase and that interpolates from said first channel samples responsive to said fractional component of said first channel phase.

9. The apparatus of claim 8 wherein said first channel high-order interpolator comprises a convolver that applies an interpolating transfer function to samples retrieved from said locations in said delay memory.

10. The apparatus of claim 9 wherein said interpolating transfer function is a windowed sinc function having parameters selected responsive to said fraction component of said first channel phase.

11. The apparatus of claim 9 wherein said interpolating transfer function corresponds to a lowpass notch filter having notches at integral multiples of a sampling rate of said monaural sound stream of digital samples.

12. In a digital sound generation system, apparatus for processing a digital sound sample stream to provide a cue indicating a simulated elevation of a sound emitter relative to a sound receiver comprising:

an integer-delay circuit that delays said digital sound sample stream by a variable integer number of time periods responsive to a desired relative elevation between said sound receiver and said sound emitter and outputs a delayed digital sound sample stream;

a fractional-delay circuit that receives said delayed digital sound sample stream and further delays said digital sound sample stream responsive to said desired relative elevation to provide a further delayed digital sound sample stream; and an adder that adds said digital sound sample stream to said further delayed sample stream to provide a comb-filtered digital sound sample stream.

13. The apparatus of claim 12 wherein said fractional-delay circuit comprises a linear interpolator.

14. The apparatus of claim 12 wherein said fractional-delay circuit comprises a higher-order interpolator.

15. The apparatus of claim 12 wherein said fractional-delay circuit comprises an all-pass filter.

16. In a digital sound generation system, apparatus for processing a digital sound sample stream to provide a cue indicating a simulated azimuth of a sound emitter relative to an orientation of a sound receiver comprising:

an integer-delay circuit that delays said digital sound sample stream by a variable integer number of time periods responsive to a desired relative azimuth between said sound receiver and said sound emitter and outputs a delayed digital sound sample stream;

a fractional-delay circuit that receives said delayed digital sound sample stream and further delays said digital sound sample stream responsive to said desired relative azimuth to provide a further delayed digital sound sample stream; and an adder that adds said digital sound sample stream to said further delayed sample stream to provide a comb-filtered digital sound sample stream.

17. The apparatus of claim 16 wherein said fractional-delay circuit comprises a linear interpolator.

18. The apparatus of claim 17 wherein said fractional-delay circuit comprises a higher-order interpolator.

19. The apparatus of claim 18 wherein said fractional-delay circuit comprises an all-pass filter.

20. In a digital sound generation system, apparatus for simulating a sonic environment of a binaural sound receiver comprising:

a first delay line having an output that provides digital sound samples for a first sound generating device and having a plurality of input points along said first delay line, each input point corresponding to a different amount of delay to the output with samples injected at each input point being summed with samples injected further from the output of said first delay line;

a second delay line having an output that provides digital sound samples for a second sound generating device physically separated from said first sound generating device and having a plurality of input points along said second delay line, each of said plurality of input points corresponding to a different amount of delay to the output; and a controller that simulates multiple paths from a simulated emitter to said sound receiver wherein, for each of said multiple paths, digital sound samples corresponding to said simulated emitter are directed by said controller to one of said plurality of input points along said first delay line and to one of said plurality of input points along said second delay line.

21. The apparatus of claim 20 wherein said multiple paths further comprise at least one path from each of a plurality of simulated emitters to said sound receiver and said controller also:

directs digital sound samples corresponding to each of said plurality of simulated emitters to one of said input points along said first delay line and to one of said input points along said second delay line to simulate each of said multiple paths from said plurality of simulated emitters to said sound receiver.

22. The apparatus of claim 20 wherein at least one of said multiple paths includes a reflection from a simulated reflective surface.

23. The apparatus of claim 20 wherein said samples of said simulated emitter are passed through an interpolator prior to insertion into said one of said plurality of input points.

24. In a digital sound generation system, apparatus for providing a cue simulating azimuth of a sound emitter relative to a sound receiver, said apparatus comprising:

a comb filter having a variable first notch frequency that receives digital sound samples and provides a comb filtered output; and a comb filter controller that continuously varies said variable first notch frequency responsive to said azimuth.

25. In a digital sound generation system, apparatus for providing a cue simulating elevation of a sound emitter relative to a sound receiver, said apparatus comprising:

a comb filter having a variable first notch frequency that receives digital sound samples and provides a comb filtered output; and a comb filter controller that continuously varies said variable first notch frequency responsive to said elevation wherein said comb filter further comprises:

an integer delay circuit that receives said digital sound samples and delays said digital sound samples by a variable integer number, d, of time units;

a first single unit delay circuit that receives an output of said integer delay circuit and delays said digital samples further by a single time unit;

a first amplifier that receives said output of said integer delay circuit and amplifies said digital samples by a factor, C;

a first summer that sums an output of said first single delay circuit together with an output of said first amplifier;

a second summer that receives an output of said first summer as a first input and further accepts a second input;

a second single unit delay circuit that receives an output of said second summer and delays said output by a single time unit;

a second amplifier that receives an output of said second single unit delay circuit and amplifies said output by a factor of −C, said second amplifier feeding said second input of said summer; and a third summer that sums a representation of said output of said second summer with the input to said integer delay circuit and provides a comb filter output.

26. In a digital sound generation system, apparatus for providing a cue simulating elevation of a sound emitter relative to a sound receiver, said apparatus comprising:

a comb filter having a variable first notch depth and a variable first notch frequency that receives digital sound samples and provides a comb filtered output; and a comb filter controller that continuously varies said variable first notch depth responsive to said elevation and said variable first notch frequency responsive to said azimuth.

27. The apparatus of claim 26 wherein said comb filter also has a variable notch depth and said comb filter controller varies said variable notch depth responsive to said azimuth.

28. In a digital sound generation system, apparatus for providing a cue simulating azimuth of a sound emitter relative to a sound receiver, said apparatus comprising:

a comb filter having a variable first notch frequency that receives digital sound samples and provides a comb filtered output; and a comb filter controller that varies said variable first notch frequency responsive to said azimuth.

29. In a digital sound generation system, an apparatus for providing a cue simulating elevation of a sound emitter relative to a sound receiver, said apparatus comprising:

a comb filter having a variable first notch depth that receives digital sound samples and provides a comb filtered output; and a comb filter controller that continuously varies said variable first notch depth responsive to said elevation wherein said comb filter comprises:

an integer delay circuit that receives said digital sound samples and delays said digital sound samples by a(n) variable integer number, d, of time units;

a first single unit delay circuit that receives an output of said integer delay circuit and delays said digital samples further by a single time unit;

a first amplifier that receives said output of said integer delay circuit and amplifies said digital samples by a factor, c;

a first summer that sums an output of said first single delay circuit together with an output of said first amplifier;

a second summer that receives an output of said first summer as a first input and further accepts a second input;

a second single unit delay circuit that receives an output of said second summer and delays said output by a single time unit;

a second amplifier that receives an output of said second single unit delay circuit and amplifies said output by a factor of −C, said second amplifier feeding said second input of said summer; and a third summer that sums a representation of said output of said second summer with the input to said integer delay circuit and provides a comb filter output.

* * * * *